US012496485B2

(12) United States Patent
Perniciaro

(10) Patent No.: US 12,496,485 B2
(45) Date of Patent: Dec. 16, 2025

(54) FITNESS DEVICE FOR LOWER BODY

(71) Applicant: Nicolas Peter Perniciaro, Meraux, LA (US)

(72) Inventor: Nicolas Peter Perniciaro, Meraux, LA (US)

( * ) Notice: Subject to any disclaimer, the term of this patent is extended or adjusted under 35 U.S.C. 154(b) by 163 days.

(21) Appl. No.: 18/597,270

(22) Filed: Mar. 6, 2024

(65) Prior Publication Data

US 2025/0281790 A1 Sep. 11, 2025

(51) Int. Cl.
*A63B 21/00* (2006.01)
*A63B 21/065* (2006.01)
*A63B 23/10* (2006.01)

(52) U.S. Cl.
CPC ..... *A63B 21/4015* (2015.10); *A63B 21/065* (2013.01); *A63B 23/10* (2013.01)

(58) Field of Classification Search
CPC ..... A63B 21/065; A63B 21/4015; A63B 21/0004; A63B 21/00058; A63B 21/00061; A63B 21/00065; A63B 21/06; A63B 21/062; A63B 21/0626; A63B 21/4011; A63B 21/4013; A63B 21/4034; A63B 23/10
See application file for complete search history.

(56) References Cited

U.S. PATENT DOCUMENTS

| | | | | |
|---|---|---|---|---|
| 5,076,263 | A | 12/1991 | Funatogawa | |
| 5,169,364 | A | 12/1992 | Donaldson | |
| 5,722,919 | A | 3/1998 | Timmer | |
| 6,238,357 | B1 | 5/2001 | Kawaguchi et al. | |
| 7,131,939 | B2 | 11/2006 | Ferri | |
| 8,002,675 | B2 * | 8/2011 | Ferri | A63B 24/00 482/79 |
| 8,439,854 | B2 | 5/2013 | Terrio | |
| D707,362 | S * | 6/2014 | Cohen | D24/200 |
| 8,932,186 | B2 | 1/2015 | Ferri | |
| 9,326,909 | B2 | 5/2016 | Liu et al. | |
| 9,937,374 | B2 | 4/2018 | Leary | |
| D835,793 | S * | 12/2018 | Zhuang | D28/57 |
| 10,537,765 | B2 | 1/2020 | Cifo | |
| 10,542,791 | B2 | 1/2020 | Cifo Garcia | |
| 11,338,173 | B2 | 5/2022 | Mattson | |
| 2011/0082403 | A1 | 4/2011 | Hill | |
| 2013/0310227 | A1 | 11/2013 | Wheeler | |
| 2014/0148315 | A1 | 5/2014 | Thompson | |
| 2018/0177664 | A1 | 6/2018 | Choi et al. | |
| 2023/0089120 | A1 | 3/2023 | Sears | |

* cited by examiner

*Primary Examiner* — Megan Anderson
(74) *Attorney, Agent, or Firm* — Dunlap Bennett & Ludwig, PLLC; Anna L. Kinney

(57) ABSTRACT

An exercise device includes a body with through holes for inserting a user's toes, a partially threaded rod, and a dowel; a weight mounted on the rod and dowel; and a threaded nut fastened to the rod. An exercise method includes gripping the device with a user's toes and actuating a joint on the leg with the device installed. The method exercises the user's lower body, including the fine musculature of the feet and toes.

6 Claims, 3 Drawing Sheets

FITNESS DEVICE FOR LOWER BODY

BACKGROUND OF THE INVENTION

The present invention relates to exercise devices and, more particularly, to a device for fitness, mobility and rehabilitation of lower body extremities including legs, ankles, feet and toes.

Existing devices for exercising the lower body include large gym equipment such as leg press machines, squat racks, ankle weights, leg curl/extension machines and calf raise machines. These existing machines are costly, require additional space and do not provide a mechanism for exercising the fine musculature of a foot and toes. However, there exists no system for training the fine musculature associated with the toes and feet.

As can be seen, there is a need for a device that can exercise the fine musculature associated with the toes and feet.

SUMMARY OF THE INVENTION

In one aspect of the present invention, an exercise device for the lower body is provided. The exercise device includes a rectangular prism shaped body that has a plurality of through holes adapted to accept a user's toes. A threaded cylindrical rod extends from the body to accept a weight or weights. The body also includes a mechanism for preventing an inserted weight from translating. The mechanism for preventing translation is a dowel affixed to the body and insertable into the weight, and a threaded nut is placed on the threaded rod to fix the weight in place.

These and other features, aspects and advantages of the present invention will become better understood with reference to the following drawings, description, and claims.

DETAILED DESCRIPTION OF THE INVENTION

Figure 1:
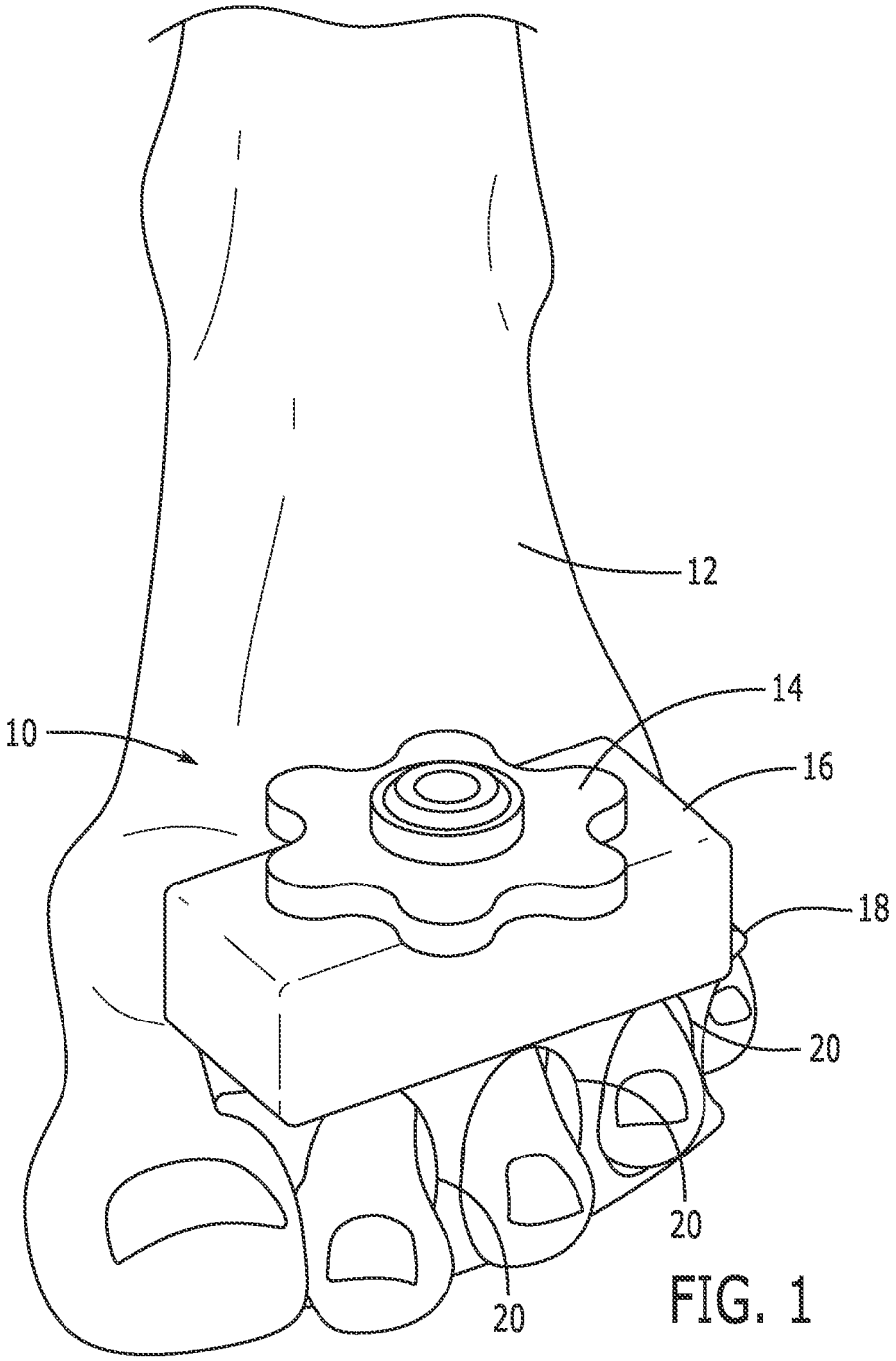
FIG. 1 is a front top perspective view of an exercise device according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is an exercise device configured for mounting on a user's toes for exercising the fine musculature of the user's feet and toes.

The exercise device may be used with a weighted block having any increment of weight sufficient to provide resistance to a user's toes, feet, ankle, or leg. The user may lift the device by articulation of a hip and knee, for example, or user could articulate one or more of the lower body joints to perform an exercise. For example, the user could articulate toe joints, ankle joints, knee joints and/or hip joints, individually or in combination.

Referring to FIGS. 1-5, FIG. 1 illustrates an exercise device 10 according to an embodiment of the present invention, comprising a weight bearing body 18 with toe holes 20 formed therein. A weighted block 16 is shown attached to the body 18 and secured by a threaded nut 14. The device 10 can be installed on the user's foot 12 by sliding the user's toes into the toe holes 20.

Figure 2:
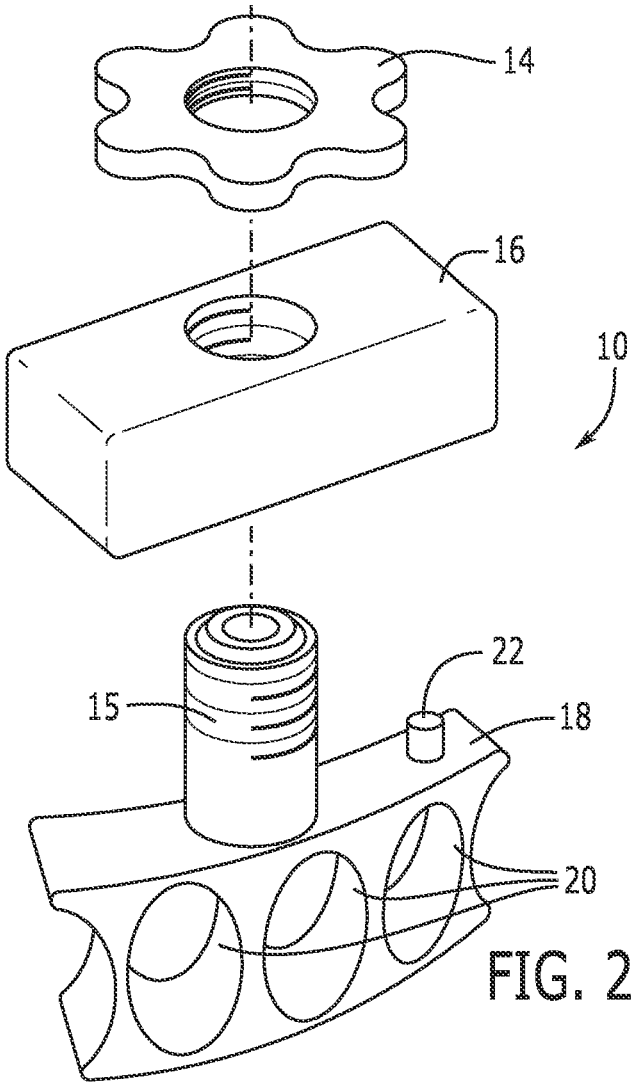
FIG. 2 is a detail exploded perspective view thereof.
Figure 3:
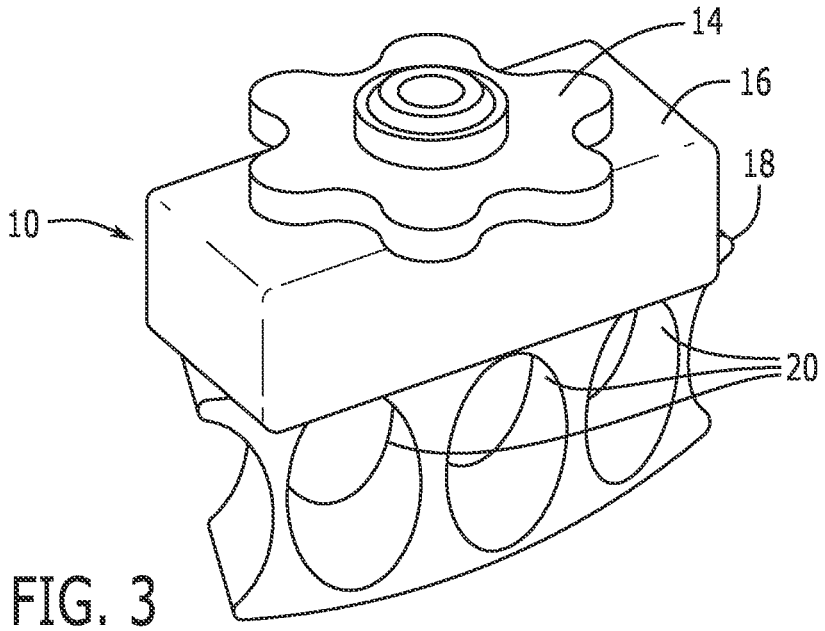
FIG. 3 is another front top perspective view thereof.

As shown in FIG. 2, a threaded rod 15 and a dowel rod 22 extend from the body 18 to secure the weight or weighted block 16. The rod 15 extends from an upper surface of the body 18, perpendicular to the toe holes 20, and is threaded from an end distal to the body 18. The weight 16 has a bore formed therethrough that may have a mated thread pattern. The dowel rod 22 extends from the upper surface of the body 18 proximal to an edge thereof to prevent translational motion of the weight 16. The threaded rod 15 may also have a smooth (unthreaded) portion proximal to the body 18, allowing the user to adjust the position of the weight 16 to insert the dowel rod 22. Once the weight 16 is mounted to the body 18, a threaded nut 14 can be fastened to the threaded portion of the rod 15. FIG. 3 illustrates the assembled device 10 with the weight 16 fastened to the body 18 with the threaded nut 14.

Figure 4:
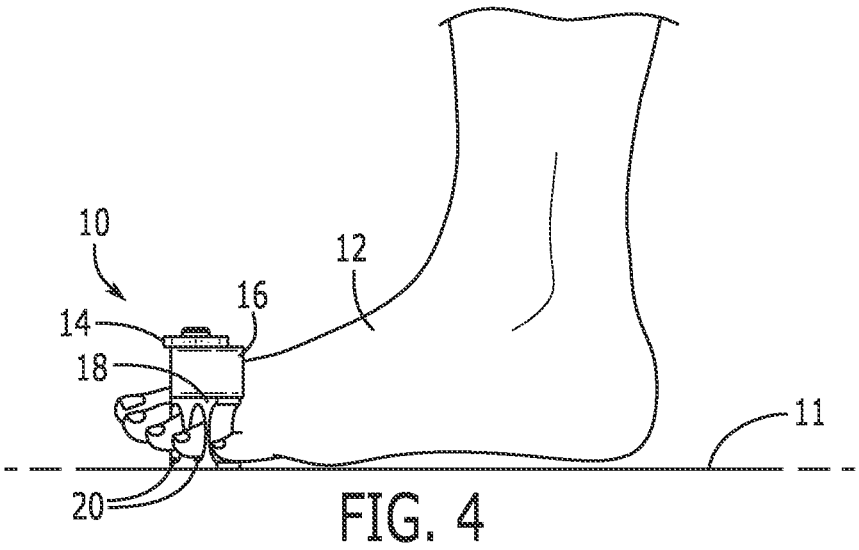
FIG. 4 is a side elevation view thereof, shown in a first position.
Figure 5:
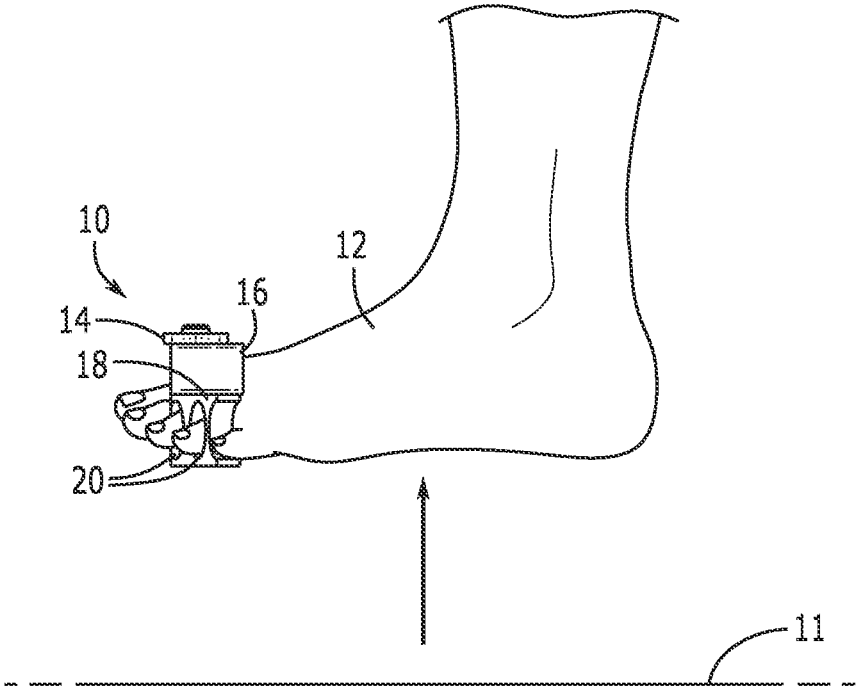
FIG. 5 is another side elevation view thereof, shown in a second position.

FIGS. 4-5 illustrate an exemplary exercise method utilizing the device 10. Once a user's toes have been inserted through toe holes 20, the device 10 may be gripped by the toes while the user articulates any joint in the lower body against the resistance of the weight 16. FIG. 4 shows the device at rest on the floor while FIG. 5 shows the lower body extremity lifted off the ground 11.

It should be understood, of course, that the foregoing relates to exemplary embodiments of the invention and that modifications may be made without departing from the spirit and scope of the invention as set forth in the following claims.

What is claimed is:

1. An exercise device, comprising:

a body having a plurality of through holes formed therein, a threaded rod extending from the body, perpendicular to the plurality of through holes, and a dowel extending from the body parallel to the threaded rod, wherein the body, the threaded rod, and the dowel are monolithically formed; and a threaded nut, threadedly mated to the threaded rod.

2. The exercise device of claim 1, further comprising:

a weight having a bore therethrough configured to accommodate the threaded rod.

3. The exercise device of claim 2, wherein the weight has a recess formed therein operative to accommodate the dowel.

4. The exercise device of claim 1, wherein the body has a rectangular prismatic configuration.

5. The exercise device of claim 1, wherein the threaded rod further comprises a non-threaded portion proximal to the body.

6. A method of exercise, comprising:

gripping the exercise device of claim 1 with at least one toe; and performing a movement engaging at least one joint selected from the group consisting of: a toe joint, an ankle joint, a knee joint, a hip joint, and any combination thereof.

* * * * *